United States Patent [19]

Wiechert

[11] 4,288,121

[45] Sep. 8, 1981

[54] TRANSPORT CAR, PARTICULARLY FOR TRANSPORTING FILES, WITH FRONTALLY ARRANGED BUMPER

[75] Inventor: Edelbert Wiechert, Berlin, Fed. Rep. of Germany

[73] Assignee: Siemens Aktiengesellschaft, Berlin & Munich, Fed. Rep. of Germany

[21] Appl. No.: 75,659

[22] Filed: Sep. 14, 1979

[30] Foreign Application Priority Data

Oct. 20, 1978 [DE] Fed. Rep. of Germany ..... 2846245

[51] Int. Cl.[3] ..... B60R 19/02

[52] U.S. Cl. ..... 293/4; 180/279

[58] Field of Search ..... 293/2, 4, 112; 180/274, 180/275, 277, 279, 280

[56] References Cited

U.S. PATENT DOCUMENTS 772,838 10/1904 Simm ..... 293/4

1,541,331 6/1925 Santis ..... 180/274

1,939,519 12/1933 Porcelli ..... 180/275

FOREIGN PATENT DOCUMENTS 2618403 10/1977 Fed. Rep. of Germany ..... 293/4

*Primary Examiner*—Robert R. Song

*Attorney, Agent, or Firm*—Hill, Van Santen, Steadman, Chiara & Simpson

[57] ABSTRACT

In an exemplary embodiment, a bumper with a handle contour is supported on a rotatably mounted lever which is arranged to actuate a switch in response to deflection of the bumper. This lever is coupled with an angle lever via a catch and the angle lever is deflected upon impact against an obstacle situated below the bumper area and, thereby, rotates the lever to actuate the switch. The disclosed arrangement serves for increasing the operational security in smaller transport cars for transporting files and goods of similar weight.

4 Claims, 2 Drawing Figures

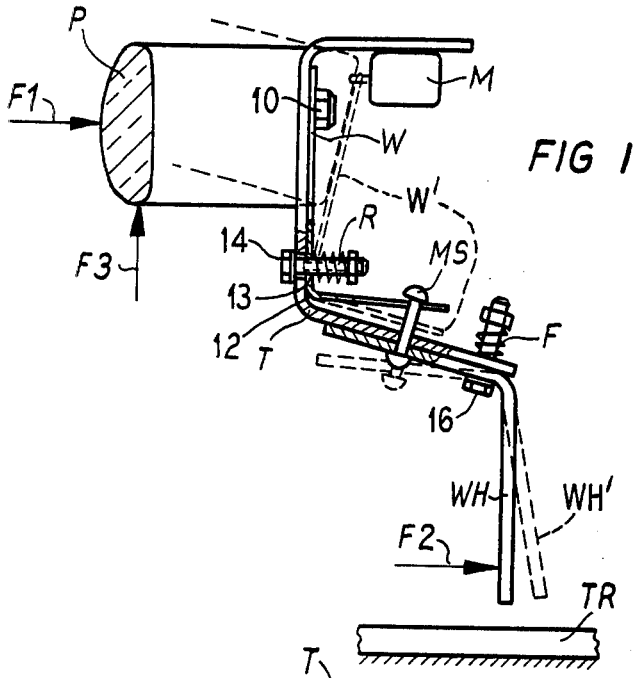
FIG 1
FIG 2
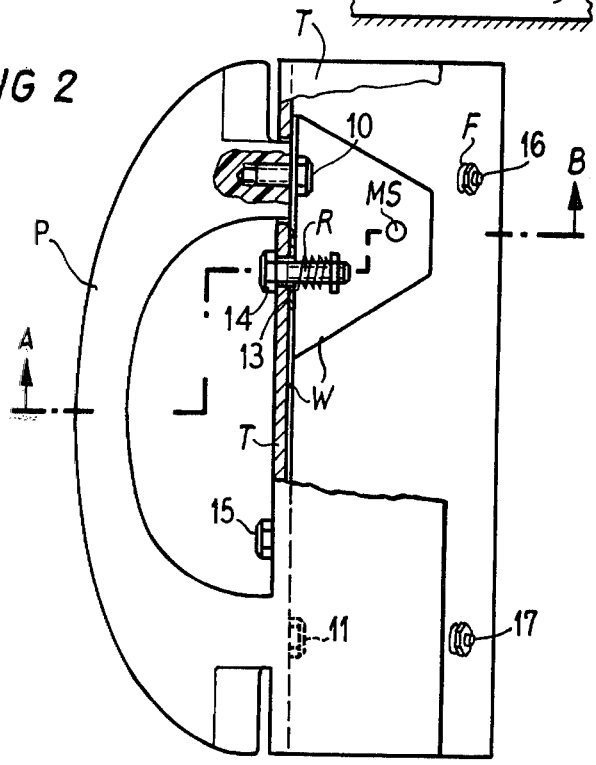

TRANSPORT CAR, PARTICULARLY FOR TRANSPORTING FILES, WITH FRONTALLY ARRANGED BUMPER

BACKGROUND OF THE INVENTION

The invention relates to a self-propelled rail-bound transport car with a frontally arranged, elastic bumper and with switch contact means actuated by the bumper upon frontal impact of the bumper against an obstacle for influencing the individual drive device of the transport car, whereby the elastic bumper exhibits a handle contour and is arranged on a rotatably seated lever which is provided with actuation means for the switch contact means.

On the one hand, thus, the bumper is designed in such manner that it forms not only a frontal impact surface but rather also a grasping surface for an operator and, on the other hand, is rotatably seated in such manner that, both upon a frontal loading of the bumper as well as upon a loading in a vertical direction caused by an operator, it actuates the contact device and, thus, prevents a premature initiation of a drive effect on the transport car; the drive can only begin when the transport car is placed on the rail line at that moment at which the operator releases the bumpers designed as handles.

Since the bumper also serves as a handle, the height of the bumper over the rail line carrying the transport car must be selected in such manner that an operator can reach under the bumper without difficulty. Beyond that, a certain minimum height over the rail is also forced in that the bumper must be able to strike against the corresponding bumpers of other transport cars in front of it in curves which lead the rail line from the horizontal into the vertical. This minimum height of the bumper above the profile rail line leads to the result that flat obstacles which lie on the rail are not engaged by the bumper. Such obstacles, however, can represent a danger for the operational security of the entire transport system since, for example, the wheels of the transport car can thereby be lifted, and the transport car can become jammed in the rail line. Insofar as the drive of such a jammed transport car continues, such a disruption can be connected with the destruction of the drive motor. This danger, however, could be countered by means of motor protection switches sensitive to temperature or excess current known per se. The provision of motor protection switches, however, does not meet all demands of accident regulations which are aimed, particularly at avoiding personal injury.

SUMMARY OF THE INVENTION

The object underlying the invention, to prevent the disruptions described and, particularly, personal injuries is achieved in that the switch-engaging bumper support lever is coupled via a catch with one arm of an angle lever rotatably mounted below the bumper support lever, which angle lever is deflected against the force of a reset spring when its second arm strikes against an obstacle on the rails under the bumper area.

The angle lever is arranged below the lever carrying the bumper in such manner that it strikes against all obstacles which lie either on the current paths or on the running paths for the wheels of the transport car. In many cases, such an impact, particularly when this occurs on the running paths of the traveling rollers of the transport car, results in the brushing away of the obstacle from the rolling surface of the traveling rollers. If, however, the obstructing object lies in lower-lying partial areas of the profile rails which are limited by sidewalls of the profile rail, then the angle lever pushes the object forward. Insofar as the obstructing object is neither pushed off of the profile rails nor does a forward pushing of the object along the profile rail occur, either a relatively great weight of the obstructing object or a friction-type or positive locking of transport car and profile rail induced by this object leads to a deflection of the angle lever which is transmitted via the catch to the bumper support lever and, thus, leads to a response of the switch contact device and the switching-off of the drive.

In the simplest realization, the catch can be realized by means of screw with a locked nut. Thereby, the catch must be freely movable at least in the area of the lever so that a rotation of the lever under the influence of the bumper does not lead to a deflection of the angle lever. Such a deflection against the force of the reset spring would lead to a reduction of the response security of the contact device.

An advantageous further development of the invention provides that the angle lever is seated below and the bumper support lever is seated above a mounting angle and that the catch passes through a recess of the mounting angle. Thereby, both the bumper support lever as well as the angle lever are supported on the mounting angle which is provided with a recess at a suitable location in order to render possible the slaving of the bumper support lever upon deflection of the angle lever.

In this conjunction, it is moreover to be viewed as advantageous that the angle lever is seated on the mounting angle by means of at least two screws which pass through aligned bores of the angle lever and of the mounting angle and are concentrically surrounded by helical springs which are prestressed by means of nuts placed on the screws. With this design, the rotating seat of the angle lever and the reset spring of said angle lever are structurally united by means of spring-screw connections.

In the following, an exemplary embodiment of the invention is explained on the basis of the accompanying sheet of drawing; and other objects, features and advantages will be apparent from this detailed disclosure and from the appended claims.

BRIEF DESCRIPTION OF THE DRAWING

FIG. 1 is a somewhat diagrammatic vertical sectional view of the frontal area of a transport car and illustrating a switch actuating lever arrangement in accordance with the present invention; and FIG. 2 is a somewhat diagrammatic top plan view of the arrangement of FIG. 1, with a portion of the mounting angle broken away.

DETAILED DESCRIPTION

FIG. 1 shows the vertical section indicated in FIG. 2 by means of the dot-dash line and which is taken in the direction of the arrows AB. A lever W has a bumper P secured therewith by means of fasteners 10 and 11, FIG. 2. The lever W has a bend at 12 which is seated against a mounting angle T, and has slots such as indicated at 13 receiving screws 14 and 15 in such a way that the lever W can rock between its solid outline position and a dotted outline position W'.

The lever W is under the influence of a reset spring R associated with each of the screws 14 and 15. A microswitch M is attached to the mounting angle T within the deflection range of the upper arm of the lever W. Upon exertion of either a frontal (force vector F1) or a vertical force directed upwards (force vector F3) on the bumper P, the lever W is translated from the normal position illustrated by means of the solid lines into the switching position illustrated with broken lines (designated W'), in which the microswitch M is actuated.

The normal position of an angle lever WH is likewise illustrated with solid lines. When the angle lever WH strikes an obstacle lying either on the live rails TR or on the areas of the profile rails TR on which the traveling rollers of the transport car ride, the angle lever WH is rotated against the force of a spring F associated with each of screws 16 and 17 in accord with the force vector F2 into the position indicated with broken lines (designated WH'). Upon rotation of angle lever WH to position WH', the lever W is translated via the catch pin MS from the position illustrated with solid lines into the position indicated with broken lines. Therewith, a rotation of the lever W until actuation of the microswitch M always occurs both upon impact of the bumper P against an obstacle as well as upon impact of the angle lever WH against an obstacle.

FIG. 2 shows the exemplary embodiment in a top view, with the upper area of the mounting angle T broken away as indicated by means of the lines drawn freehand. It can be seen from this that the bumper P is firmly connected to the lever W by means of the screws 10 and 11. As already mentioned, the lever W is caused to actuate the microswitch (M in FIG. 1) given either a horizontal or an upward vertical rotation of the bumper (P in FIG. 1).

It will be apparent that many modifications and variations may be effected without departing from the scope of the novel concepts and teachings of the present invention.

I claim as my invention:

1. A rail-bound transport car with self-drive means and frontally arranged bumper means (P) and with switch contact means for actuation upon frontal impact of the bumper means against an obstacle for influencing the transport car self-drive means; said bumper means comprising a bumper providing a handle contour; a mounting angle (T); a bumper movement sensing lever (W) having said bumper arranged thereon, and being pivotably mounted on said mounting angle (T), and having actuation means for actuating said switch contact means upon pivotal movement of said bumper movement sensing lever (W) in response to frontal impact of the bumper against an obstacle; reset spring means (R) acting on said bumper movement sensing lever (W) to oppose the pivotal movement thereof, a catch (MS); and an angle lever (WH) having a mounting arm and a depending arm, and the mounting arm being rotatably mounted below said bumper movement sensing lever (W) on said mounting angle (T) and being coupled with said bumper movement sensing lever (W) by said catch (MS), said angle lever (WH) being arranged for deflection upon impact of the depending arm of said angle lever (WH) against an obstacle located on the rails below the area of said bumper, so as to pivot said bumper movement sensing lever (W) by means of said catch (MS).

2. A rail-bound transport car according to claim 1, characterized in that the catch is formed by means of a screw with a locked nut.

3. A rail-bound transport car according to claim 1, characterized in that the mounting angle (T) is supported by the car, and the angle lever (WH) is seated below and the bumper movement sensing lever (W) is seated above the mounting angle (T) and in that the catch (MS) passes through a recess of the mounting angle (T).

4. A rail-bound transport car according to claim 3, characterized in that the angle lever (WH) is mounted on the mounting angle (T) by means of at least two screws (16, 17) which pass through aligned bores of the angle lever (WH) and of the mounting angle (T) and are concentrically surrounded by helical springs (F) which are prestressed by means of nuts placed on the screws.

* * * * *